US006817301B1

(12) United States Patent
Bullock

(10) Patent No.: US 6,817,301 B1
(45) Date of Patent: Nov. 16, 2004

(54) RAILROAD FREIGHT CAR TRUCK SUSPENSION YAW STABILIZER

(76) Inventor: Robert Lee Bullock, 180 Dudala Way, Loudon, TN (US) 37774-6806

( * ) Notice: Subject to any disclaimer, the term of this patent is extended or adjusted under 35 U.S.C. 154(b) by 0 days.

(21) Appl. No.: 10/763,496

(22) Filed: Jan. 23, 2004

Related U.S. Application Data

(60) Provisional application No. 60/496,838, filed on Aug. 21, 2003.

(51) Int. Cl.[7] ..... B61F 15/00

(52) U.S. Cl. ..... 105/182.1; 105/197.05; 105/207

(58) Field of Search ..... 105/165, 167, 105/168, 182.1, 190.1, 190.2, 192, 193, 194, 197.05, 198.2, 207

(56) References Cited

U.S. PATENT DOCUMENTS 1,640,179 A * 8/1927 Buckwalter ..... 105/182.1
3,315,555 A * 4/1967 Travilla ..... 105/157.1
4,570,544 A 2/1986 Smith
5,503,084 A * 4/1996 Goding et al. ..... 105/218.1
5,555,816 A * 9/1996 Jones ..... 105/168
5,746,134 A * 5/1998 Scheffel ..... 105/168
5,992,330 A 11/1999 Gilbert et al.
6,439,130 B1 * 8/2002 Scheffel ..... 105/167

* cited by examiner

*Primary Examiner*—Mark T. Le
(74) *Attorney, Agent, or Firm*—Alfred D. Lobo

(57) ABSTRACT

Yaw stabilization device provides a light-weight mechanism for increasing the linear yaw stiffness levels between the side frame and bolster to provide the proper inter-axle shear stiffness without affecting the compliancy required of the vertical suspension system. This invention, which fails to increase the unsprung weight of a railroad car truck assembly noticeably, may be retrofitted to existing freight car trucks in service or incorporated into newly manufactured trucks. Moreover, it does so without the need for damping wedges to increase interaxle shear stiffness and allow the wedges to function optimally for control of vertical vibrations.

27 Claims, 8 Drawing Sheets

RAILROAD FREIGHT CAR TRUCK SUSPENSION YAW STABILIZER

CROSS-REFERENCE TO RELATED APPLICATION

This application claims the benefit of the filing date of Provisional Application Ser. No. 60/496,838 filed 21 Aug. 2003.

FIELD OF THE INVENTION

This invention relates to a railroad freight car truck suspension which is used to carry a freight car over the rails of a railroad, and more particularly to a means for mitigating the detrimental effects of using a conventionally designed railroad freight car truck at both relatively high and low speeds, the high speed being in excess of 80 kmh (kilometers per hour) or 50 mph (miles per hour) and the low speed being less than 40 kmh or 25 mph in curves where excessive yaw is a critical problem.

BACKGROUND OF THE INVENTION

A typical railroad freight car is provided with a pair of trucks located at opposite ends of the freight car to support its body. Such a truck is provided with a pair of wheelsets each of which comprises an axle, a pair of spaced wheels and a tapered roller bearing assembly mounted at each axle end, and the truck is pivoted to the body of the freight car to permit its trucks to negotiate a curve. A conventional truck, referred to as a "three piece truck" includes a pair of longitudinal side frames with a pair of wheelsets extending between the side frames, at opposite ends of the side frames. By "longitudinal" is meant the direction in which a truck is translated along rails, or the direction in which the rails extend. The wheelsets are journalled to rotate about a horizontal axis to allow the truck to roll along rails. The side frames are interconnected by a bolster that is mounted to each side frame by inserting the bolster through a through-window known as a "window opening" in each side frame. The central lateral axis of the bolster in a freight car truck at rest, is essentially at right angles to the longitudinal central axis of a side frame. The bolster's ends are supported on a set of springs in each side frame, to accommodate vertical, and to a smaller extent, lateral loads, and the springs are seated within spring seats on the side frame. The bolster is pivotally connected to the body of the freight car to provide the necessary connection between the body and the truck. The bolster may be displaced vertically relative to the frames, depending upon the loading of the bolster, but lateral displacement of the bolster is limited by vertical ears known as "bolster gibs" projecting from the bolster. The interface between the bolster and side frame includes spring loaded wedges ("friction wedges") which fix the longitudinal movement of the bolster, and, to a lesser extent, control the vertical and lateral and rotational motions between the bolster and the side frames.

Because the friction wedges permit the transmission of longitudinal forces and rotational forces and/or torsional moments from the side frames to the bolster, any difference in the magnitude of these forces at each end of the bolster will, when the resistance due to friction between the bolster and car body is exceeded, cause pivoting of the bolster in the horizontal plane. In addition to such movement of the bolster any imbalance in the magnitude of vertical forces exerted on the spring-supported ends of the bolster caused by a first pair of wheels on one side of a pair of wheelsets, on one side of the truck, will tend to unload the other end of the bolster which will move vertically relative to the second pair of wheels of the wheelset on the opposite side of the truck. This accommodation of vertical movement allows the truck to travel over track which is uneven and maintains a good load distribution between the four wheels of the truck.

Though the conventional truck side frames provides a very stiff longitudinal constraint which maintains the wheelsets parallel to one another the conventional design is ineffective in keeping the wheelsets aligned in a lateral direction in the horizontal plane. The imposed lateral loads generated between wheel and rail at a high speed above 80 kmh on straight track and lower speeds below 40 kmh on curved track tend to rotate the side frames about the ends of the bolster allowing misalignment of the wheelsets or truck warping.

First, the action at higher speeds: the problem is exacerbated when there is warping or an in phase yaw displacement in which the wheel sets remain parallel to one another but not perpendicular to the side frames. This in phase yaw displacement is commonly known as lozenging and results in two undesirable characteristics. Firstly, an unstable condition known as hunting can occur in which the yaw displacements occur in a continuous oscillatory manner excited by the action of the wheels against the rails. Such a motion promotes high wheel and rail wear, causes high shock levels to be transmitted to the rails and the vehicle body and can, in extreme cases, lead to derailment of the vehicle.

The second action occurs on curves. When the vehicle travels on curves of sufficiently small radius to cause the leading wheelset to come into flange contact with the outer rail the wheelset experiences a yaw torque which turns it toward the outer rail. This creates a very high angle of attack of the leading axle with the rail and it is well known that such high angles of attack result in high levels of wear and noise as well as creating high force levels and the possibility of derailment.

One solution to such lozenging has been to use trucks having a rigid H frame. In this type of construction the bolster and side frames are integrally formed so that relative longitudinal displacement (in the direction of the rails) between the side frames cannot occur. Such frames tend to be extremely rigid so that their ability to accommodate vertical movement between the axles is not very good, and it has been shown that such rigidity results in a relatively low critical velocity, that is, the velocity at which instability occurs is typically less than 80 kmh.

It has also been suggested to use two braces extending diagonally between the side frames and bolted and/or welded to each other at their intersection. This construction is effective in controlling instability and improving "curving" since the construction has a high warp stiffness and is not rigid; however, it is subject to failure due to fatigue resulting from vibration.

In North America and in other countries that follow the North American practices, the conventional three-piece freight car trucks in railroad freight service have evolved to satisfy a variety of important operating and economic requirements. Freight car trucks must be capable of safely supporting and equalizing very high wheel loads over a wide range of track and operational conditions while delivering a high level of economic value. The three-piece trucks in service today are being challenged by ever increasing demands for improved performance. Effective Jan. 1, 2003, this demand for better performance reached a new level when the Association of American Railroads ("AAR")

issued a new specification M-976-2002, "Truck Performance Specification For Rail Cars," that sets the performance requirements for all freight car trucks. Most all current freight car truck designs are failing to meet all of the performance requirements of the new AAR specification. The main reason for the failure is the conflicting requirement for good vertical flexibility and high inter-axle shear stiffness or truck warp stiffness.

Freight car truck design requirement for the proper selection of suspension springs and friction dampers along with the proper selection of a higher than normally available interaxle shear stiffness was known in the early 1970's (see AAR Track Train Dynamics Program Phase I & II). In order to meet the vertical suspension requirements larger friction damping wedges with higher damping forces were developed (see U.S. Pat. No. 5,511,489 to Bullock, inter alia). In order to increase the inter-axle shear stiffness various additional structures have been added to the three-piece freight car truck. These attempts include a spring plank connecting the spring seats of the truck side frames (Weber Patents and List U.S. Pat. No. 4,483,253), directly inter-connecting the wheelsets to each other through a sub-frame (U.S. Pat. No. 4,131,069 to List & U.S. Pat. Nos. 4,067,262; 4,067,261; and 4,151,801 to Scheffel) and inter-connecting the side frames to each other using a cross brace system (U.S. Pat. No. 4,570,544 to Smith). All of these designs increase the inter-axle shear stiffness to the proper level (greater than 40,000 pounds per inch) without affecting the vertical suspension system. However, none of these designs were generally accepted by the railroad industry due to economic factors and the additional weight the stiffening frames added to the freight car truck.

Another means for increasing the yaw stiffness between the truck side frame and bolster is to connect the bolster and side frame together with a stabilizing bar or anchor (U.S. Pat. No. 5,992,330 to Gilbert). This method has been used on railroad locomotives and passenger cars for over seventy years. These railroad vehicles have a very low net to tare ratio or very little vertical spring deflection from empty to loaded conditions. However, a railroad freight car, on the other hand, has a large change in weight from empty to loaded car conditions resulting in a much higher change in spring heights. Therefore, a fixed length bar or anchor cannot accommodate the different lengths required of it for the empty to loaded freight car spring deflections.

Since the 1970's the generally accepted practice for increasing the inter-axle shear stiffness was to increase the yaw resistance between the side frame and truck bolster through changes in design of the friction wedge interface with the truck bolster pocket and side frame columns. This included wider friction wedges as in the '489 patent, more acute wedge angles (U.S. Pat. No. 5,544,591 to Taillon) and split wedges, inter alia. These approaches to friction wedge design predominates the current freight trucks in North American railroad service. In order to meet the new AAR Specification M-976-2002 there are indications from recent tests that the wedging action within the vertical suspension that is required to give adequate interaxle shear resistance interferes (locks up) with the compliancy of the vertical suspension system to accommodate the required specified track conditions.

SUMMARY OF THE INVENTION

The yaw stabilization means disclosed herein provides a light-weight means for increasing the linear yaw stiffness levels between the side frame and bolster to provide the proper inter-axle shear stiffness without affecting the compliancy required of the vertical suspension system. This invention, which fails to increase the unsprung weight of a railroad car truck assembly noticeably, may be retrofitted to existing freight car trucks in service or incorporated into newly manufactured trucks.

The goal of this invention is to dispense with the need of using damping wedges to increase interaxle shear stiffness and allow the wedges to function optimally for control of vertical vibrations.

The stabilizing means comprises a "yaw yoke" comprising a "pivot bar" and a pair of oppositely disposed diverging spring arms. The pivot bar is pivotable on a pivot means, preferably a ball-pivot, fixed at the longitudinal central axis of the side frame. The pair of diverging spring arms extend towards the bolster on either side of the longitudinal axis through the ball-pivot; one spring arm lies in a position inside the longitudinal axis and is referred to as the "inside spring arm"; lying inside the truck, the inside spring arm is not visible from outside the truck. The other spring arm lies in a position outside the longitudinal axis and is referred to as the "outside spring arm." To connect the inside spring arm to the bolster near the end thereof, but inside of the truck (inside the longitudinal axis of the side frame), the bolster is provided with an anchoring means in the form of an anchoring stub welded to the bolster, the stub having a "coupling end", for example, a hooked end or more preferably a ring, to couple with one end of a linking means, preferably a "coupling link" (this one referred as a "first link") such as one conventionally used in chain assemblies to hoist heavy objects. The term "linking means" is used to describe the interconnection of structural elements of the yaw stabilizer, irrespective of how they are connected to serve the purpose of a link. The other end of the first link is linked or coupled to the end of the inside spring arm, which, like the anchoring stub, is provided with a coupling end, for example, a hooked end, or more preferably a ring. To connect the outside spring arm to the bolster, preferably at the end thereof, outside the longitudinal axis of the side frame, the bolster is provided with a rocker arm pivotable about a vertical rocker pin. One end of the rocker arm is provided with a coupling end to which a second coupling link (this one referred to as a "second link") is coupled; the other end of the second link is coupled to the end of the outside spring arm. The other end of the rocker arm is provided with a through-passage having a Spiralock female thread with a bolt and jam nut, allowing the end of the rocker arm to be forced away from the bolster's surface when the bolt ("pre-loading bolt") is tightened against the bolster's surface and locked in place by the jam nut.

The loading bolt provides a critical function for optimum performance—it preloads the arms of the pivot bar to a pre-determined load required for the proper truck initial inter-axle shear resistance and shear rate. In addition, for proper inter-wheelset shear spring rate, the vertical plane through a linking means, and, a vertical plane through the first pivot means and an end of the linking means held in the end of the first arm of the pivot bar, forms an acute angle. To provide a desired loading, the coupling end of the stub anchor is positioned for optimum performance of the truck under designated conditions. The location of the coupling end which determines the position of one end of the link may be calculated by one skilled in the art.

In the foregoing configuration, adjustment of the stabilizing means for the truck may be readily made by torquing the pre-loading bolt from outside the truck. Because the position of the coupling end on the anchoring stub inside the truck is fixed, no adjustment of anything inside the truck is required.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

In service, railroad freight car wheelsets have an effective conicity greater than zero. In curves this allows one wheel of a wheelset to have a different surface speed from its mate wheel for the same rotational speed. However, when one wheel of a railroad wheelset rolls on different radius than its matched wheel an un-squaring moment or torque is imposed upon the freight car truck. This un-squaring moment will cause the side frame to rotate about the end of the bolster in the horizontal plane. If the un-squaring moment is not properly resisted, the wheelset will assume such a position that a derailment would occur. Other than from the friction wedges there is no substantial restoring moment between the bolster and side frame.

The yaw stabilizer provides the proper linear restoring moment when the side frame is rotated about the end of the bolster. The term "linear" is used in the mathematical modeling sense, in that there is no friction damping or gap elements, only a spring. When this rotation starts, each of the spring arms of the yaw stabilizer is pulled inward by the fixed length coupling links connected to the bolster. This loading of the spring arms causes a proper linear restoring moment or torque between the side frame and bolster. The resulting stabilization forces exerted on the bolster and side frames when the truck is warped, stabilizes the truck so as to allow it to travel at any speed up to 160 km/hr (100 mph) on relatively level standard track, and up to 240 km/hr (150 mph) on specially prepared level track.

Figure 1:
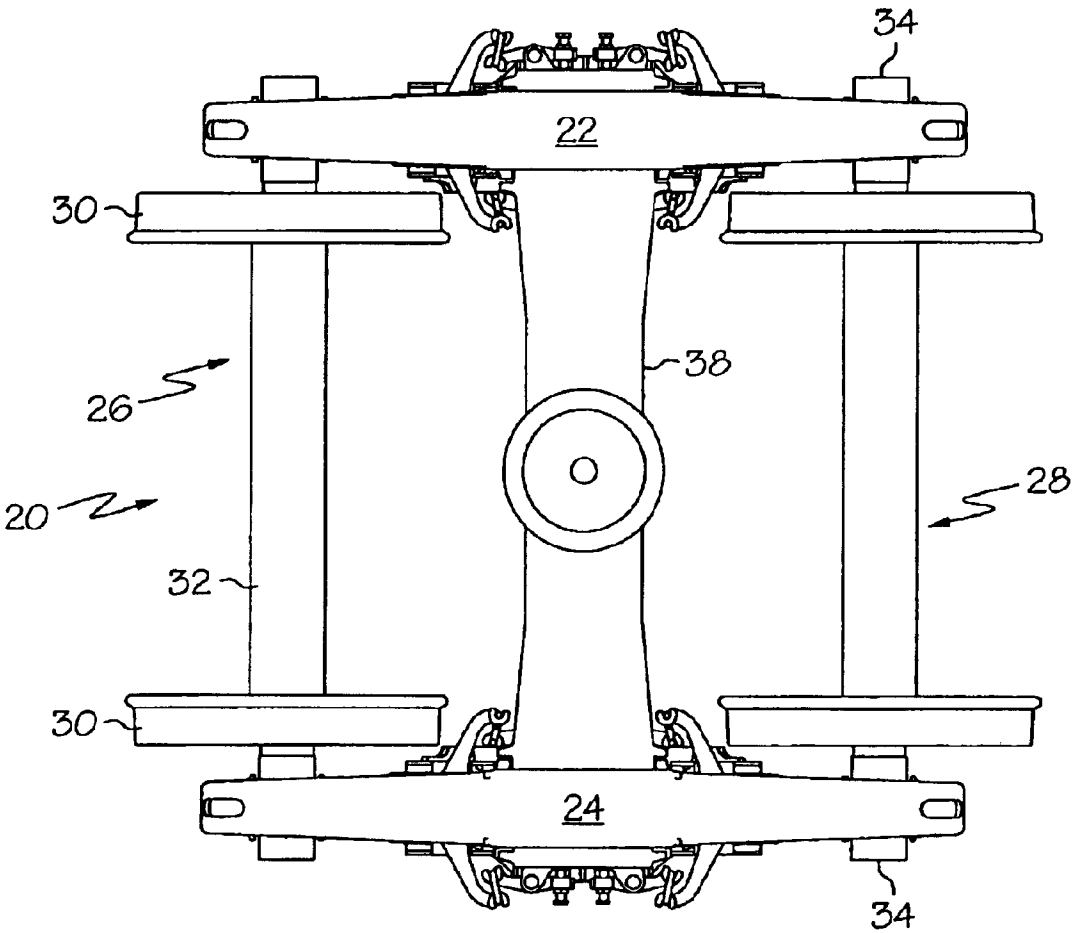
FIG. 1 is a schematic illustration of a top plan view of the truck.
Figure 2:
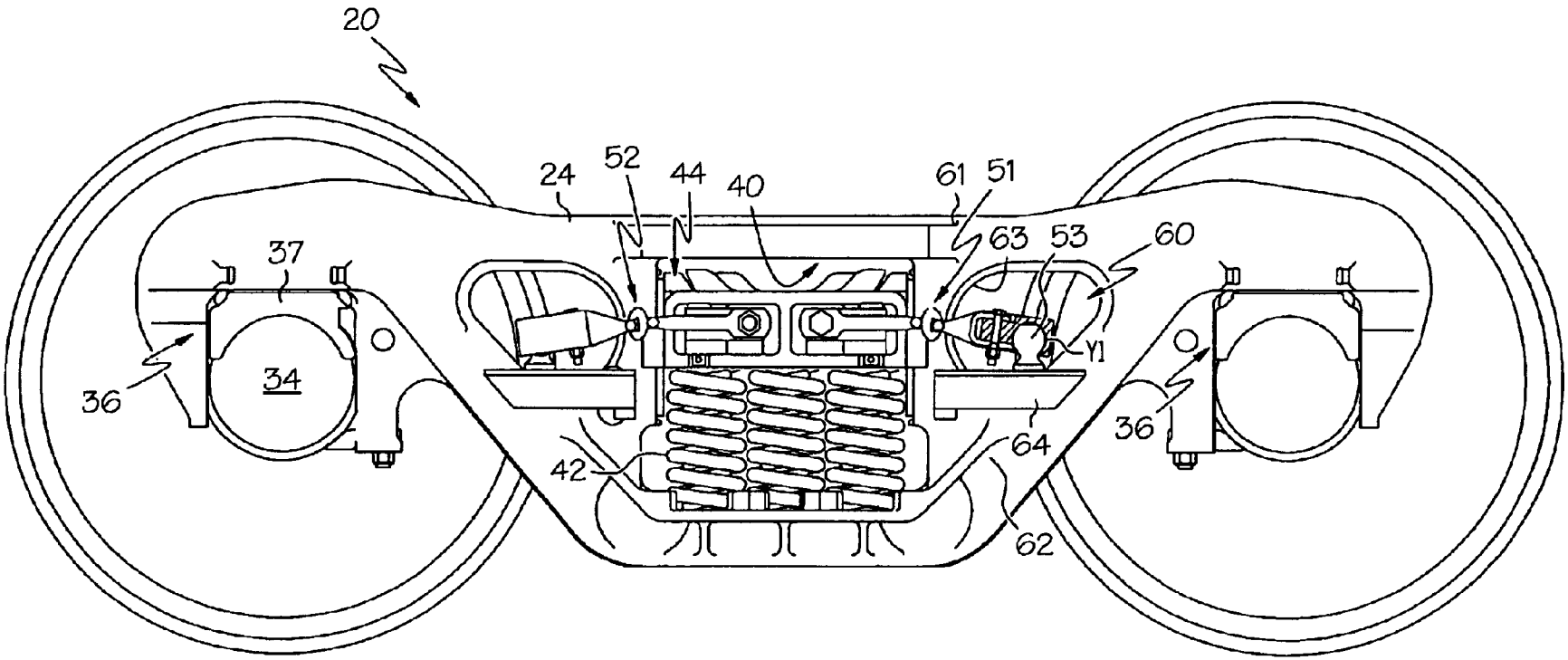
FIG. 2 is a schematic illustration of a side elevational view of a truck, viewed in the lateral direction, showing a pair of stabilizing means ("stabilizers") on ball-pivots mounted in opposed side openings of a side frame.

Referring now to FIGS. 1 and 2 in the drawing, a truck 20 includes a pair of longitudinal side frames 22–24 supported by a pair of wheelsets 26–28. Each wheelset includes a pair of flanged wheels 30 secured to an axle 32, the ends of which are supported by a roller bearing means 34 in a side frame pedestal jaw 36 in each end of the side frames 22–24 so that the axles may rotate about a generally horizontal axis relative to the side frames. Preferably an adapter pad 37 is positioned between each roller bearing 34 and pedestal jaw 36 to provide a primary suspension for the axle assembly and to permit limited controlled movement of the wheelsets out of parallel.

A bolster 38 extends between the side frames 22–24 and passes through a window opening 40 formed in the central portion of each side frame. The ends of the bolster 38 are supported on a spring assembly 42 to permit vertical movement between the bolster 38 and the side frames 22–24 and bear against friction wedges 44 in pockets between the bolster and the vertical column members of the window opening 40 so that the bolster may move vertically but not longitudinally relative to the side frames in a conventional manner.

The foregoing is a description of a conventional freight railcar truck, two of which are typically used in tandem to support the body of the railcar; less typically, trucks may be shared by adjacent railcars. The yaw stabilization assembly ("stabilizer"), identified generally by reference numeral 51 of this invention may be used to stabilize yaw in any conventional truck; it is most preferred to use a pair of stabilizers 51 and 52 on each side frame, the stabilizers including yokes Y1 and Y2 pivotable to a predetermined extent in both the horizontal and vertical planes, each yoke equidistantly spaced apart from the vertical centerline of the side frame and in substantially mirror-image relationship with each other.

Yaw stabilizer 51 includes yoke Y1 pivotable on a spherical ball-pivot 53 rigidly affixed (e.g., welded) on one side of side frame 24, on the longitudinal center line of the side frame, each ball-pivot 53 essentially equidistant from the lateral centerline of the truck and the side frame. The ball-pivot 53 may be mounted within side frame opening 60, defined by elongated vertical and angulated members including upper compression member 61, sloping tension member 62 and vertical column member 63, as illustrated in FIG. 2 by securing the base of the ball-pivot to a ball-pivot support plate assembly 64 to the sloping tension member 62 and vertical column member 63. The ball-pivot may be mounted on the side frame's upper surface, but the geometry of the stabilizer is far less satisfactory than when the ball-pivot is mounted in the side frame's opening. A usable ball-pivot 53 is similar to one used in a Class IV trailer hitch mounted for use with light trucks ("pick-up trucks") and sports utility vehicles (SUV's).

Figure 5:
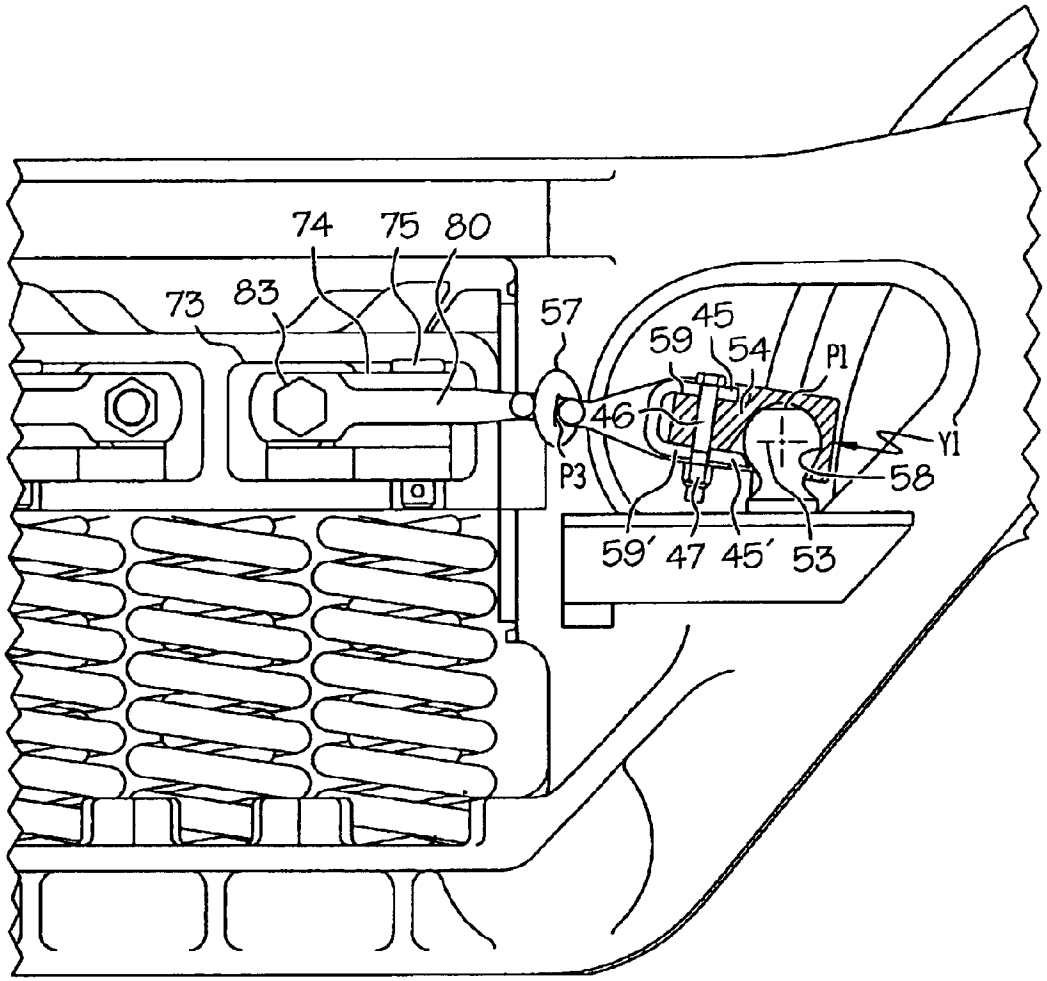
FIG. 5 is a detailed elevational view, partly in cross-section through a central vertical plane through the ball-pivot mounted on a sloping tension member of a side frame.

Referring to FIG. 5 there is illustrated in a yoke Y1 comprising a pivot bar 54 provided with a concavity 58 adapted to matingly accept and snugly engage the ball-pivot 53 so that the pivot bar 54 is pivotable about plural axes passing through point "P1" on the center of the ball-pivot. The upper and lower surfaces 59, 59' respectively of the central portion of the pivot bar 54 adjacent the concavity 58 and between the spring arms 55, 55' are milled so as to be snugly held between the upper and lower arms 45 and 45' respectively, of a keeper clip. The milled portion and the arms of the clip are provided with vertically aligned through-passages in which a bolt 46 is inserted and secured with a nut 47. The end of lower arm 45' of the keeper clip extends to an interfering position adjacent the lower surface of the ball-pivot 53, to secure the pivot bar on the ball-pivot.

Figure 3:
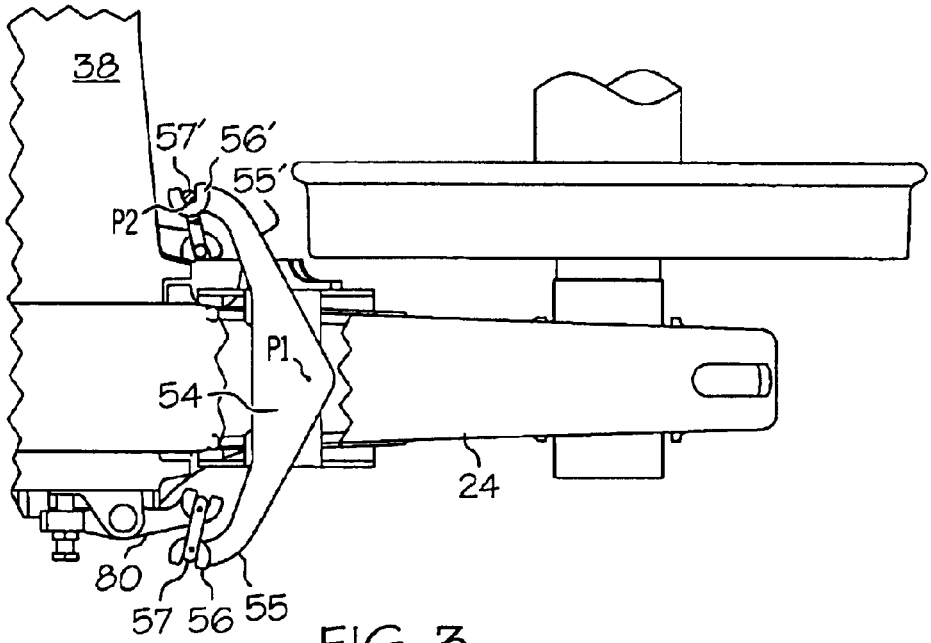
FIG. 3 is a top plan view of one side frame and a portion of the bolster with portions of the side frame cut away, to graphically illustrate the most preferred symmetric disposition of a pair of stabilizing means on a side frame in which axles of the wheelset are journalled, and to show that the adjustment means for pre-loading the stabilizer is on the outside of the truck (that is, outside the longitudinal central axis of the side frame).

As shown in FIG. 3, each pivot bar 54 is provided with a pair of spring arms 55, 55' preferably made of spring steel (e.g. AISI 5160H) designed to provide the proper spring rate due to bending. Outside spring arm 55 and inside spring arm 55' are each provided with hooked ends 56, 56' respectively, adapted to engage bolster links (e.g., chain type "continuous" links having a fixed length) 57, 57' each of which links is connected to the bolster 38, at locations on opposite sides of the longitudinal centerline of the side frame 24.

Figure 6:
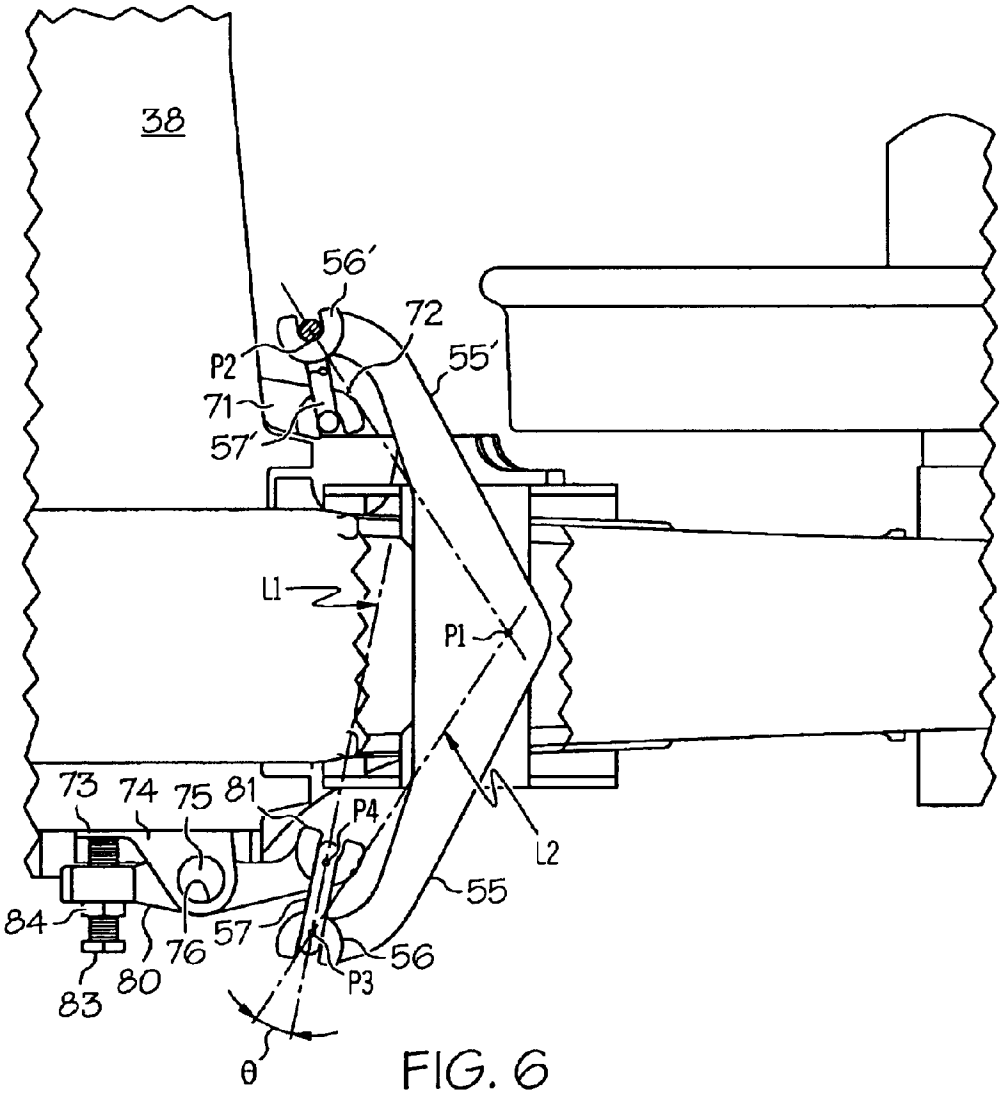
FIG. 6 is an enlarged detail plan view with portions of the side frame and bolster cut away, graphically illustrating the "acute" angulated relationship of the linking means relative to a vertical plane through the ball-pivot and the point at which the link is tightly held in the end of an outside spring arm.

FIG. 6 shows in plan view, in greater detail that the inside spring arm 55' is preferably connected to the bolster 38 by fixing, as by welding, an inside stub anchor 71 to the bolster, the stub anchor having a hooked end 72 adapted to engage one end of link 57'; when the other end of link 57' is engaged in the hooked end 56' of spring arm 55' at point "P2", the point of contact between the inner surface of the link 57' and the surface of the hooked end 56', the distance between points P1 and P2 is fixed for specified conditions for any particular truck.

Figure 4:
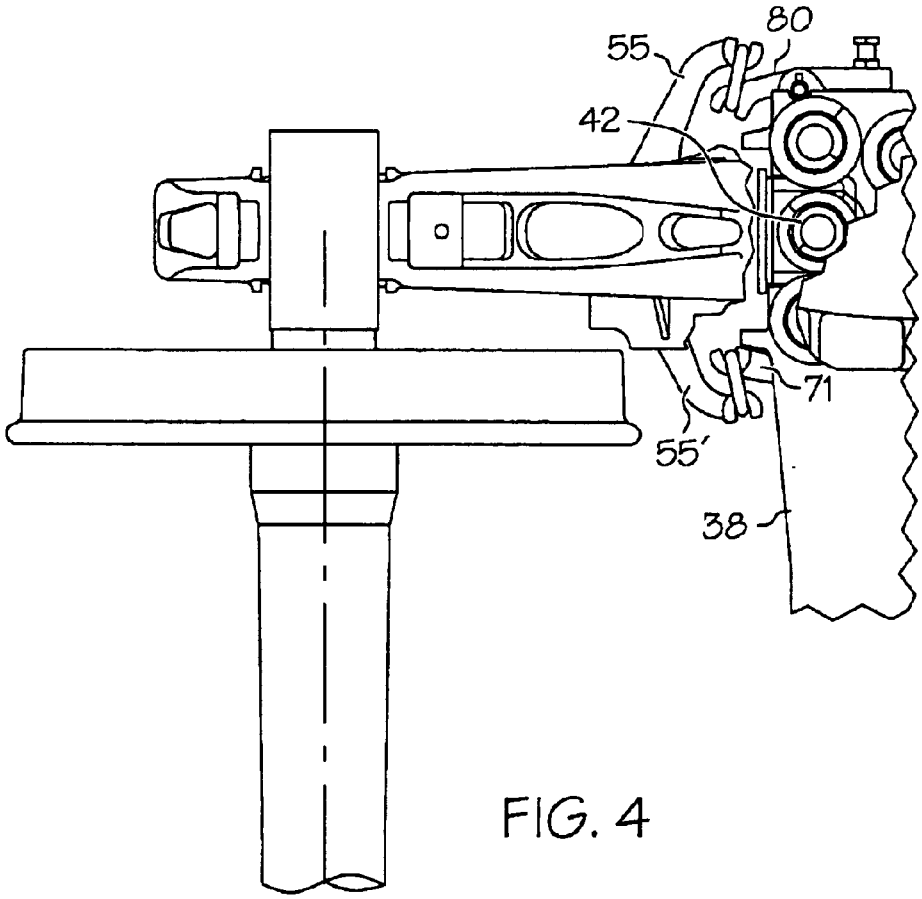
FIG. 4 is a bottom plan view of FIG. 3 showing the suspension spring set in the spring seat and linking means for the spring arms on either side of the side frame.

FIG. 4 is a bottom plan view of FIG. 3 showing that adjustment with the rocker arm 80 is conveniently done because it is easily accessible, and its connection to the outside spring arm 55 is readily visible, unlike the linked connection of inside spring arm 55' to the inside anchor stub 71.

The outside spring arm 55 is preferably connected to the bolster 38 by fixing, as by welding, a pivot block 73 inside the open end of the bolster, the pivot block 73 having a clevis 74 having vertically aligned through-apertures 76 through which a standard railroad brake pin 75 may be inserted.

Figure 7:
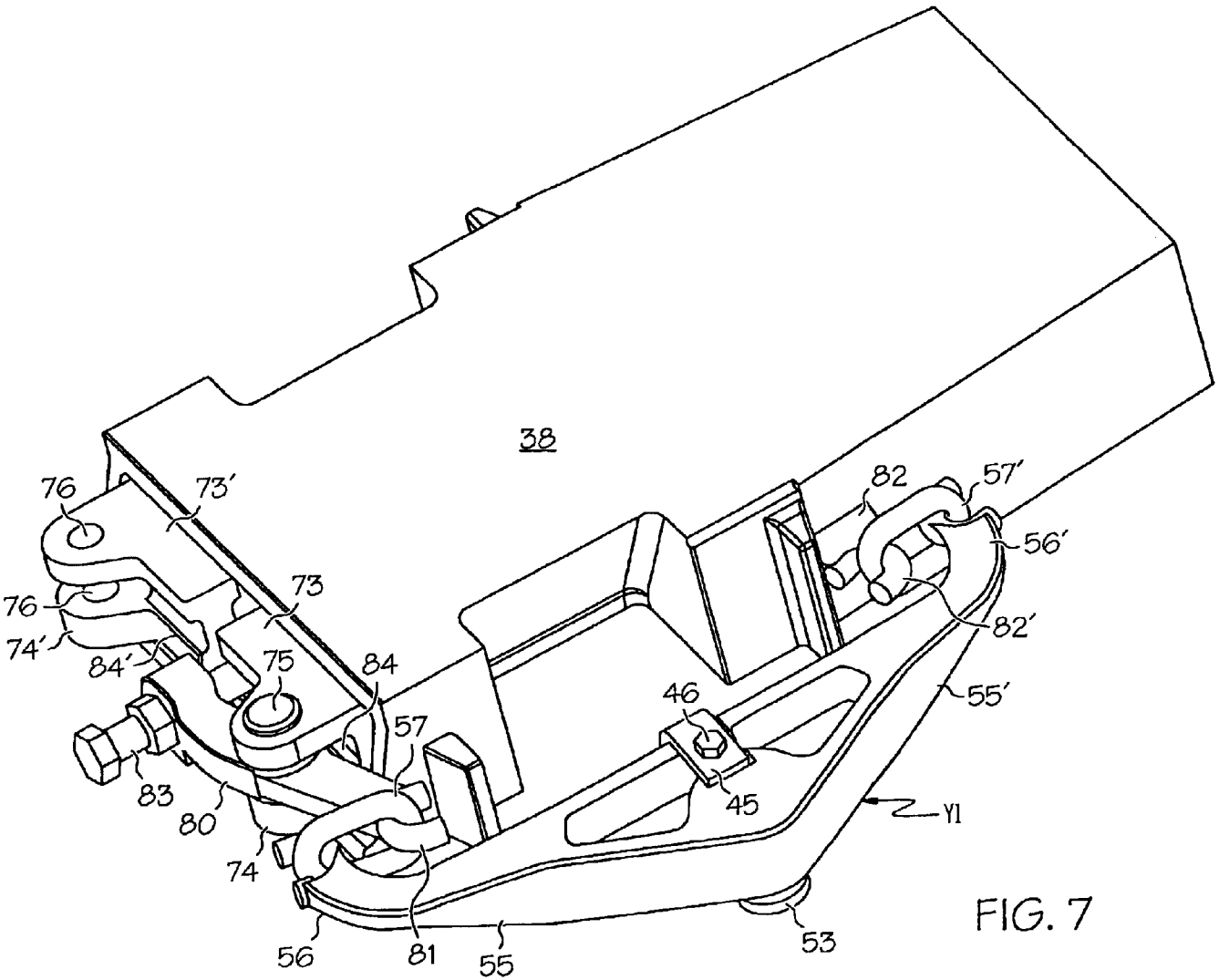
FIG. 7 is an isometric view of a yoke connected to one end of a bolster in which a pair of pivot blocks is inserted, each block having a clevis; a vertical pin is inserted in each clevis (only one pin is shown); a horizontal groove in each block limits vertical movement of the end of an adjusting bolt.

FIG. 7 is an isometric view of a pair of pivot blocks 73, 73', one a mirror-image of the other relative to the lateral centerline of the bolster, each of which pivot blocks is dimensioned to be slidably snugly inserted into, and welded on the end of the bolster 38. Each pivot block includes a clevis 74, 74' located so as to allow a brake pin 75 to be inserted through its arms and provide a pivot axis for a rocker arm 80. Only the rocker arm 80 is shown (the other rocker arm positioned in mirror-image relationship, is not) and the lower end of the adjusting bolt 83 is held in groove 84 in the pivot block 73 so as to limit the bolt's vertical movement. The grooves 84, 84'(in pivot block 73') also maintain the position of each bolt 83 (83' in clevis 74' is not shown) when the spring arms are being preloaded.

The rocker arm 80, slidably inserted and positioned in the clevis 74, is pivotably disposed on the brake pin 75. One end of the rocker arm 80 is provided with a hook 81 adapted to engage one end of link 57 the other end of which is engaged in hooked end 56 of spring arm 55. Clevis 74' is similarly provided with an adjustable rocker arm positioned in mirror image relationship with rocker arm 80 to preload spring arm 55' (not shown) on the opposite side of the bolster.

Hooked end 56' of spring arm 55' is linked by link 57' to inside stub anchor 82 secured on the bolster, the anchor having a hooked end 82'. The hooked ends 56' and 82' of the spring arm 55' and the stub anchor 82 respectively are linked together before the spring arms are preloaded by biasing the hooked end 56 of spring arm 55 towards the longitudinal center line of the side frame with the hooked end 81 of the rocker arm.

Reverting to FIG. 6, a line L1 connecting point P3 where the inside surface of one end of link 57 contacts the surface of hooked end 56, and point P4, where the inside surface of the other end of link 57 contacts the surface of hooked end 81, defines the angular orientation of link 57. It is critical for optimum performance that this angular orientation is such that the angle between a line through P3 and P4 and a line L2 through P3 and P1 be an acute angle $\theta$, that is, less than 90°, preferably less than 50°.

To ensure the proper preloading of the spring arms, the other end of the rocker arm is provided with a threaded bore through which an adjustment bolt 83 is threadedly inserted and locked with jam nut 84. The bolt 83 is preferably provided with a hex head which can be turned to bias the end of the bolt against the pivot block 73 in the end of the bolster until the spring arms 55 and 55' are pre-loaded in opposed bending to the desired extent. The vertical axis of the brake pin 75 is laterally displaced relative to the longitudinal axis of the side frame.

The combined length of the links 57 and 57' is most preferably such that the vertical location of the ball-pivot is mid-way between locations of the links at empty and loaded car conditions; in such a configuration, the links do not cause bending in the spring arms for a given suspension spring deflection at either empty or loaded car conditions. The minimum link length may be determined by keeping the yaw stabilizer angle of the spring arm to its center line constant and then determining the link length at empty and loaded spring deflection, using the law of cosines for a triangle with the ball-pivot 53 located vertically near the mid-point between empty and loaded car. The minimum length is ineffective to substantially bend a spring arm for a predetermined spring suspension because the link allows the requisite relative motion between the bolster and the side frame.

Each link on a spring arm allows the arm to be vertically displaced, as each arm will be, when there is a vertical deflection of the bolster when the springs in the spring set of the bolster are compressed and extended. The maximum compression is determined by the height of the suspension springs at which the springs are incompressible, that is, function as a solid. In this configuration, with up-and-down movement of the bolster, the spring arms will have substantially the same deflection whether the car is loaded or empty.

When pre-loaded, the stabilizer 51 is supported by the ball-pivot 53 and the tension in the bolster links 57, 57'. In general the mass of the stabilizer 51 is at least one hundred (100) times less than the spring-arms pre-load. This ratio is necessary in order to prevent damaging natural vibration in the stabilizer assembly.

Because the side frame spring seat is lower than its support points on the roller bearings a pendulum effect is created on the side frame which will center the bolster laterally with respect to the side frame. The yaw stabilizers do not interfere with this lateral motion. The yaw stabilizer follows the lateral displacement of the bolster by rotating on its supporting pivot ball with very little additional loading in the spring arms.

The yaw stabilizer spring arms require a bending spring rate greater than 178 kg/cm (1000 lb/in) to provide the proper restoring moment or torque between the side frame and bolster.

While the spring arms are so deformed due to the un-squaring moments being imposed upon the freight car truck, the vertical suspension is free to move without any additional vertical loading from the yaw stabilizers.

The pair of yaw stabilizers on each side frame can follow the vertical displacement of the truck bolster by rotating on the supporting ball pivot in the vertical plane.

It is expected that four yaw stabilizers mounted on a freight car truck shall provide at least 7142 kg/cm (40,000 lb/in) of linear inter-axle shear stiffness.

It will now be evident that in a preferred embodiment, the yaw stabilization means for each truck comprises a pair of stabilizers mounted in substantially mirror image relationship, one to the other, on each side frame, along the longitudinal axis of the side frame, each stabilizer having two spring arms extending towards the bolster; a pair of inside anchor stubs rocker arms welded to the bolster on a longitudinal axis in substantially mirror-image relationship with each other relative to the lateral central axis of the truck; a pair of rocker arms pivotably mounted on the bolster, on a longitudinal axis, in substantially mirror-image relationship with each other relative to the lateral central axis of the truck; and, linking means connecting each rocker arm to an arm of the stabilizer. Each pivot bar is pivotable so as to permit its spring arms to be displaced a limited distance so that the angle between a line through points P1 and P3, or a line through points P1 and P2 and the lateral line through P1 parallel to the central lateral axis of the bolster is less than sixty degrees (60°).

In operation, the pair of yaw stabilizers together fail to effect any change in the centering force between the bolster and each side frames, because with lateral deflection of the bolster (in a direction at right angles to the central longitudinal axis of the side frame), each yaw stabilizer pivots on its respective pivot ball and adds no additional lateral force to the configuration. The twin yaw stabilizers together increase the yaw stiffness between the side frame and the bolster without affecting the suspension system or the friction damping in the suspension system. Preferably the ball-pivot is located, in a vertical direction, between the point at which a link is anchored to the bolster under fully loaded conditions of the car, and when the car is empty.

However, because the spring arms of each yaw stabilizer are attached by links to the bolster, on opposite sides of the lateral axis, there is a net restoring torque or linear stiffness between the bolster and the side frame. The restoring force is a result of the yaw relative to the bolster and the side frame which forces the spring arms of each yaw stabilizer (all four spring arms), together, to be pulled inward towards the center line through the pivot means and the yaw stabilizers. For optimum performance, it is critical that each of the stabilizers is preloaded by biasing the distal ends of each spring arm towards the longitudinal center line of the side frame, that is, towards each other. The preloading serves to store energy in the spring arms to counter the lateral displacement of wheelsets. Since the preloading force is exerted within the yaw stabilizer only, the force has no measurable effect on either the vertical action of the bolster or the lateral centering of the bolster with respect to the side frame.

It will now be evident that even a single stabilizing means on a truck will provide a substantial measure of yaw stabilization; better stabilization will be provided by having a pair of stabilizing means, whether both on one side frame, or one on one side frame and the other on the other side frame; most preferably, a truck is provided with four stabilizing means, one pair on each side frame. Recognizing that there is a statistical probability of failure of one or more of the four yaw stabilizers on each truck, it is worth noting that such failure will not cause any damage greater than the loss of the benefit the failed stabilizer provides; further, such failure is readily easily discovered because each stabilizer is visible with a normal inspection such as is required for brake shoes. Further, this embodiment allows adjustment of preload and/or replacement of non-welded stabilizer components at any "repair in place" (RIP) track facility; or, in a "one spot" repair shop without any special tools.

It is recognized that the function of the rocker arm and adjusting bolt could be replaced by a specially designed electrical, hydraulic or pneumatic power tool to preload the stabilizer spring arms and attaching the outside link 57 to an outside stub anchor 89 having a hooked end 89' in a manner similar to that in which the inside link 57' links hooked end 56' of spring arm 55', but this configuration is not preferred since such an embodiment would require special tools for in-the-field adjustment and/or assembly, and once the spring arms are linked to the bolster, the degree of preloading is not readily adjustable.

Figure 8:
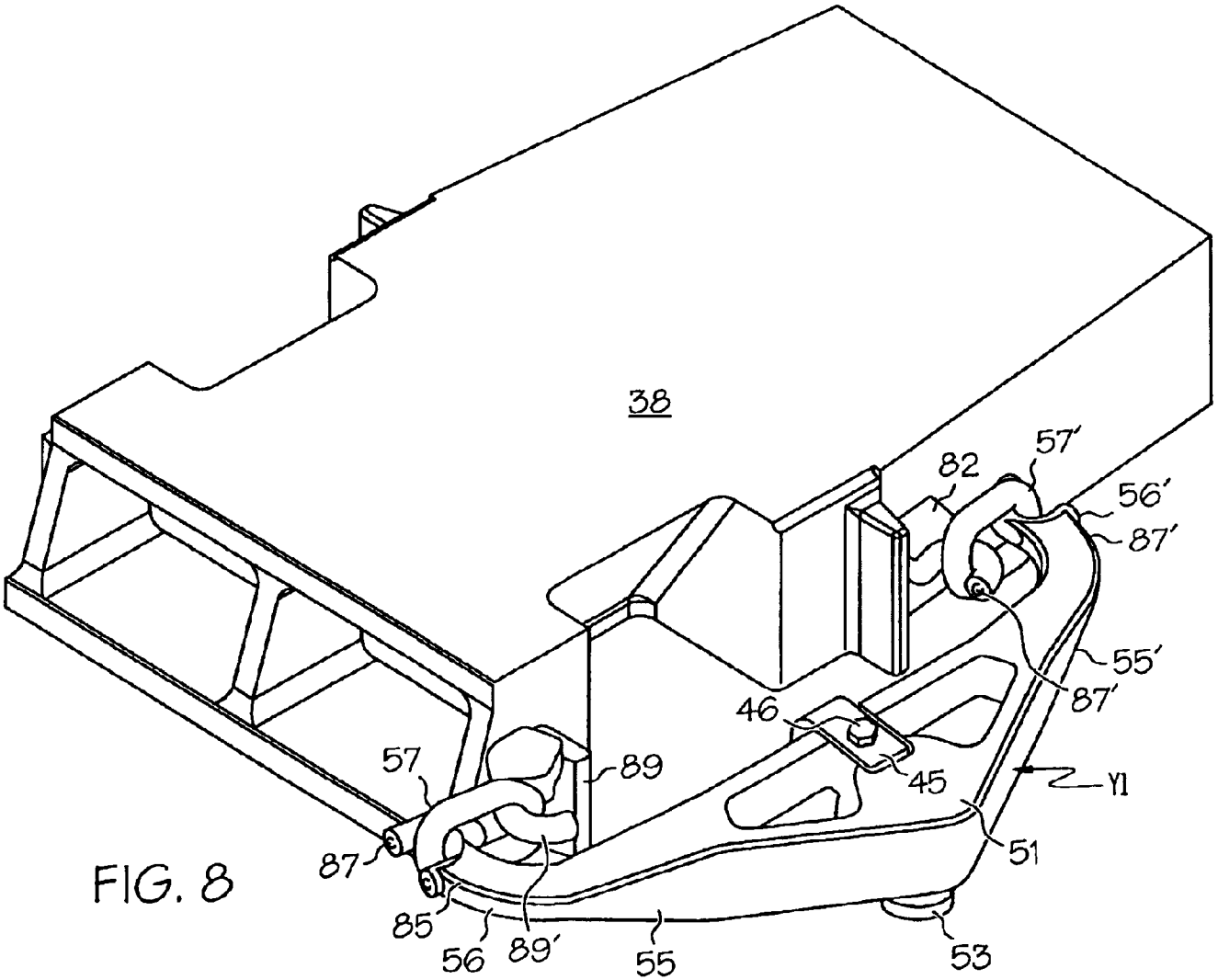
FIG. 8 is an isometric view of a yoke in which the inner and outer coupling ends of each spring arm are engaged in inner and outer stub anchors, respectively, fixed to the bolster on opposite sides of the longitudinal centerline of the side frame; each of the stub anchors is provided with a coupling end to couple a coupling link shared with a spring arm.

Referring to FIG. 8, there is shown an isometric view of a yoke Y1, of a pair of stabilizers 51 and 52 (not shown) positioned on a side frame (not shown) in mirror image relationship with each other relative to the lateral centerline of the bolster 38. Each yoke has outer and inner spring arms 55 and 55'respectively which are preloaded to a predetermined amount which cannot be changed unless the length of the links 57 and 57' are changed. As before, the outer and inner spring arms 55 and 55' are provided with hooked ends 56 and 56' respectively in which one end of each link 57, 57' is engaged, the other end of each link being engaged in the hooked ends 89', 82' of outside 89 and inside 82 stub anchors respectively. Outer spring arm 55 is provided with a detent 87 adjacent the hooked end 56 and another detent 87' adjacent the hooked end 56' of inner spring arm 55' which detents provide purchase for hooked jaws of a pneumatic power tool such as a spring-arm pre-loader" (not shown).

The spring-arm preloader may be made from brake components used for maintenance of railroad freight cars, which components are readily available in a facility used to maintain railroad freight cars. The preloader comprises a pair of standard railroad "brake levers" referred to as 25.4 ×cm 50.8 cm (in the U.S. as 10"×20") brake levers, spaced apart by a connecting rod about the same length as the distance between the hooked ends of a spring arm; this rod, referred to as a "rod-thru truck lever connector" is provided with standard brake pins, one pin near each end of the rod. Each of the brake pins is adapted to be inserted in a through-aperture in each brake lever, each through-aperture being provided on the longitudinal centerline of each brake lever, about 25.4 cm (10") from one end, to allow the rod-thru lever connector to be positioned above a side frame, directly above the hook ends of the yaw stabilizer, and have the two brake levers be pivotable so that their lower ends extend to the hooked ends of a spring arm located in the opening of the side frame. Each lower end of the 10×20 brake lever is provided with a hooked jaw, one in mirror-image relationship with the other, together adapted to engage the opposed ends of a spring arm in detents provided therein, so that when the jaws are forcefully moved towards each other, the spring arms are compressed. To provide the requisite compressive force, the upper ends of each brake lever are connected to the ends of the arms of a standard railroad 30.48 cm (12") diameter air-actuated cylinder, preferably suspended from a portable A-fame. When the cylinder is actuated to drive the ends of the brake levers away from one another, they are pivoted on the brake pins so as to force the hooked jaws (on the lower ends of the brake levers) towards each other thus compressing the spring arm.

Typically, first, the inner spring arm 55' will have link 57' of predetermined length engaging both, the hooked end 56' of spring arm 55', and the hooked end 82' of the stub anchor 82. The spring arm pre-loader is able to exert enough force on the spring arms 55, 55' to draw them towards each other sufficiently to allow the link 57 to be placed over hooked end 89' of the outside stub anchor 89 so as to engage it with hooked end 56 of the outside spring arm 55. This outside connection is made after link 57' has secured an inner connection (which would otherwise be difficult to engage) between inner stub anchor 82 and inner spring arm 55'. To change the preloading on the spring arms, the spring arms 55 and 55' are pulled together sufficiently to allow the outside link 57 to be removed before the inner link 57'. The links are then replaced with other links having a length chosen to provide the new preloading conditions.

From the foregoing it will now be evident that, though it is critical for optimum performance that the spring arms be preloaded, how they are preloaded is not. The choice of preloading means depends in large part upon whether it is to be adjustable or not. If preloading is to be adjustable and readily doable without specialized equipment, the adjustable rocker arms are most preferred. If preloading is to be non-adjustable, and specialized equipment is readily available, then having a pair of oppositely fixedly disposed stub anchors may be preferred.

Figure 9:
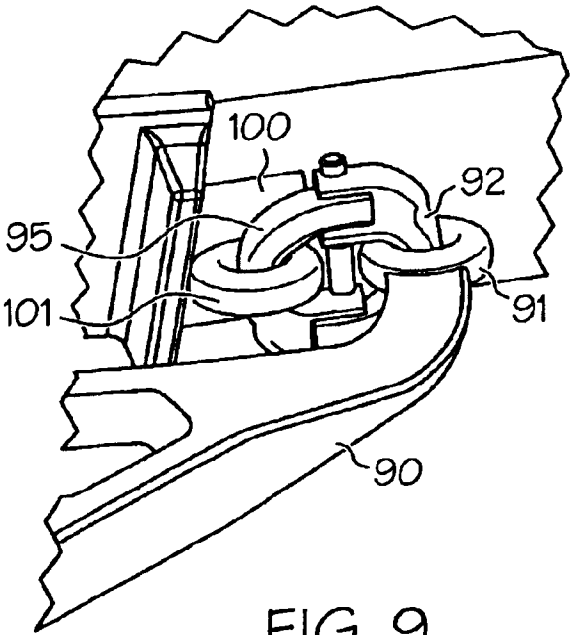
FIG. 9 is a detail, in an isometric view, showing an inside stub anchor and an inside spring arm, each having a ring for its coupling end, the rings coupled with a split coupling link having identical half-link bodies pinned together after they one has been rotated 180° relative to the other to lie in the same plane.

Referring now to FIG. 9 is shown a detail of a one end of a spring arm 90 provided with a preferred embodiment of a coupling link, other than a hooked end. Instead of a hooked end provided in the prior embodiments, this coupling link is a ring 91 formed in the end of the spring arm. Stub anchor 100 is also provided with a coupling end which is a ring 101. Each ring 91 and 101 have inside diameters large enough to have identical split links (also referred to as "half links") thrust through the rings. A first split link 92 inserted through ring 91 and a second split link 95 is inserted through ring 101.

Figure 10:
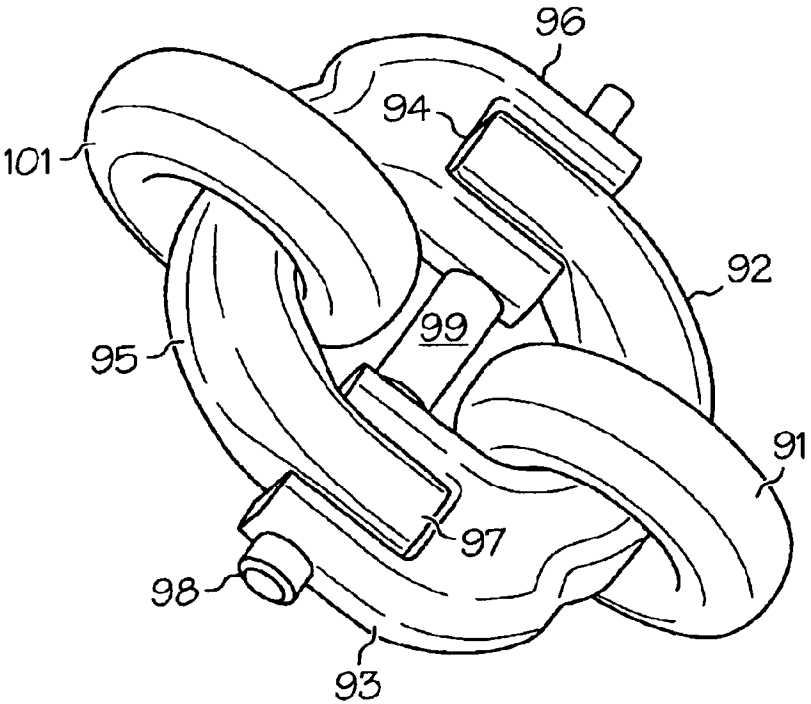
FIG. 10 is a detail, in an isometric view, showing how two rings are coupled with a split coupling link.

Referring to FIG. 10 there is shown in greater detail, the rings 91 and 101 at the end of the spring arm 90 and on stub anchor 100, without the remaining portions of the structures of each, to illustrate the coupling of the rings with the assembled split links 92 and 95 which together form a heavy-duty coupling link. One end of the first split link 92 has a clevis 93, the other end 94 does not; and the clevis 93 and end 94 have aligned through-bores. Analogously, second split link 95 has a clevis 96 at one end, and the other end 97 does not; and, as before, the clevis 96 and end 97 have aligned through-bores so that when the respective ends of the split links 92 and 95 are interdigitated, all the through bores are aligned to afford passage for a pin 98. To provide additional stiffness, the pin 98 is thrust through a compression tube 99 (also referred to as a strut spacer) snugly fitted between the inner surface of clevis 93 and the inner surface of clevis 96. The rings provide greater strength than hooked ends for the same mass though assembling the coupling links on preloaded spring arms may be more demanding than hooking hooked ends 87 and 87' to "continuous" links 57 and 57' such as shown in FIG. 8.

Described hereinabove is a method for controlling yaw of a side frame in a horizontal plane about the end of a bolster without adding stiffness to the truck except for stabilization forces when the truck components are warped, comprising, locating a pivot means on the side frame at a location adapted to accommodate the loaded and empty conditions of a car; pivotably mounting a yoke having inner and outer spring arms extending outwardly symmetrically from the center line through the pivot means; providing a "fixed and adjustable" connection (as exemplified by twin oppositely disposed rocker arms pivotably disposed on a pivot pin in a pivot pin block in FIGS. 6 and 7) connection, or a "fixed and non-adjustable" (once fixed, as exemplified by anchors in FIGS. 8 and 9) connection, with a link adapted to be engaged with the distal end of each spring arm, and the corresponding bolster connection, one on either side of the longitudinal axis through the side frame; and, loading both spring arms by biasing one of the spring arms towards the other spring arm in an amount adapted to counter the forces generated by the relative lateral displacement of the wheelsets.

In each of the embodiments referred to immediately above and illustrated in FIGS. 6, 7, 8 and 9, each spring arm is preferably fabricated so that it has a stiffness greater than 178.3 Kg/cm or one thousand pounds force per inch (1000 lbf/in) of deflection. Further, it is preferable that the numerical value of the stiffness of each spring arm is greater than one hundred (100) times the numerical value of the combined mass of the pivot bar and its spring arms, using compatible units of measure.

Having thus provided a general discussion, described the overall apparatus in detail and illustrated the invention with specific illustrations of the best mode of making and using it, it will be evident that the invention has provided an effective solution to an age-old problem. It is therefore to be understood that no undue restrictions are to be imposed by reason of the specific embodiments illustrated and discussed, and particularly that the invention is not restricted to a slavish adherence to the details set forth herein.

What is claimed is:

1. In a railroad car truck assembly having longitudinally spaced apart wheel sets, transversely extending axles, and wheels mounted to the axles, transversely spaced apart longitudinally extending side frames mounted to the axles, and a transversely extending bolster mounted to the side frames, the improvement comprising, a yaw stabilizing means mounted on a side frame, and distally disposed relative to the lateral centerline of the truck, the yaw stabilizing means comprising, a first pivot means mounted on the side frame at a location distally disposed relative to the lateral centerline of the truck;

a pivot bar pivotably disposed on the pivot means, the pivot bar having a pair of first and second spring arms, the first spring arm being located inside the longitudinal axis of the side frame and the second spring arm located outside, each spring arm diverging substantially equiangularly from a central vertical plane through the pivot means and along the longitudinal axis therethrough, each end of each spring arm extending toward the lateral center line of the bolster, the first spring arm adapted for engagement with a first linking inside the longitudinal axis of the side frame, and the second spring arm having a second linking means outside the longitudinal axis of the side frame;

inside and outside anchoring means in laterally spaced-apart relationship on a side of the bolster, near an end thereof, and on opposite sides of the longitudinal axis of the side frame, the inside anchoring means being adapted to engage the first linking means at a predetermined location laterally spaced apart from the longitudinal centerline of the side frame, and the outside anchoring means being adapted to engage the second linking means at a predetermined location laterally spaced apart from the longitudinal centerline of the side frame;

whereby the spring arms connected to the bolster through the linking means actively controls relative rotational movement of the side frame relative to the bolster.

2. The assembly of claim 1 wherein the first pivot means is mounted in a side frame opening defined by elongated substantially longitudinal, vertical and angulated members of the side frame.

3. The assembly of claim 1 wherein each spring arm, near each end, is provided with a hook, and each anchoring means is provided with a hook, each hook of a spring arm being adapted to be coupled to an adjacent hook of an anchoring means; and, the linking means is a continuous link.

4. The assembly of claim 1 wherein each spring arm, near each end, is provided with a ring, and each anchoring means is provided with a ring, each ring of a spring arm being adapted to be coupled to an adjacent ring of an anchoring means; and the linking means is an assembly of split links.

5. The assembly of claim 1 wherein the outside anchoring means includes a second pivot means mounted near one end of the bolster, the second pivot means adapted to provide a rocker arm with a rocking motion through a predetermined arc in the lateral plane, one end of the rocker arm being adapted to engage the second linking means, and the other end being adapted to be biased away from the bolster's surface to preload the stabilizing means.

6. The assembly of claim 5 wherein the second pivot means is a vertically disposed pivot pin in a clevis block fixed to the bolster.

7. The assembly of claim 1 wherein the spring arms are preloaded, and, the vertical plane through each linking means and a vertical plane through the first pivot means and an end of the linking means held in the end of the first spring arm of the pivot bar, forms an acute angle.

8. The assembly of claim 1 wherein each side frame of the truck has a yaw stabilizing means disposed thereon.

9. The assembly of claim 1 wherein each side frame of the truck has a pair of yaw stabilizing means disposed thereon, one oppositely mounted in substantially mirror-image relationship with the other.

10. The assembly of claim 1 wherein each linking means has a minimum length ineffective to substantially bend a spring arm for a predetermined suspension spring deflection.

11. The assembly of claim 5 wherein the rocker arm includes locking means to lock one end of the arm when biased against the bolster to pre-load both spring arms in opposed bending to each other.

12. The assembly of claim 5 wherein each spring arm, near each end, is provided with a hook, each rocker arm near its one end is provided with a hook, and each anchoring means is provided with a hook, each hook of a spring arm being adapted to be coupled to a hook selected from an adjacent hook of an anchor block and an adjacent hook on a rocker arm, and the linking means is a continuous link.

13. The assembly of claim 5 wherein each spring arm, near each end, is provided with a ring, and each rocker arm near its one end is provided with a ring, and each anchoring means is provided with a ring, each ring of a spring arm being adapted to be coupled to a ring selected from an adjacent ring of an anchor block and an adjacent ring on a rocker arm; and the linking means is an assembly of split links.

14. The assembly of claim 1 wherein each spring arm has a stiffness greater than one thousand pounds force per inch (1000 lbf/in) of deflection.

15. The assembly of claim 1 wherein the numerical value of the stiffness of each spring arm is greater than one hundred (100) times the numerical value of the combined mass of the pivot bar and its spring arms, using compatible units of measure.

16. In a railroad car truck assembly having longitudinally spaced apart wheel sets, transversely extending axles, and wheels mounted to the axles, transversely spaced apart longitudinally extending side frames mounted to the axles, and a transversely extending bolster mounted to the side frames, the improvement comprising, a pair of first and second yaw stabilizing means oppositely mounted in substantially mirror-image relationship with each other, on each side frame;

the first yaw stabilizing means comprising a first pivot means mounted on a side frame at a location distally disposed relative to the lateral centerline of the truck; and, the second yaw stabilizing means comprising a second pivot means mounted on the same side frame at a location equidistant from the first pivot means and on the same longitudinal line through the first pivot means;

each first and second pivot means having a pivot bar pivotably mounted thereon, the pivot bar having a pair of first and second spring arms, each spring arm diverging substantially equiangularly from a central vertical plane through the pivot means along the longitudinal axis therethrough, an end of each arm extending toward the lateral center line of the bolster, the spring arms being preloaded to a predetermined extent;

a pair of first and second anchoring means oppositely disposed and fixed to the bolster on either side of the longitudinal axis of each side frame, the anchoring means being adapted for engagement with first and second linking means, respectively, on opposite sides of the longitudinal axis of the side frame;

the first linking means adapted to engage one end of a first anchoring means to one end of a first spring arm;

the second linking means adapted to engage one end of a second anchoring means to one end of the second spring arm;

each linking means adapted to provide limited movement of each spring arm in a lateral plane, each linking means having a minimum length ineffective to substantially bend a spring arm for a predetermined suspension spring deflection;

whereby both, limited lateral movement of the bolster and such vertical movement as is provided by suspension springs in the side frames, is provided for; and each yaw stabilizing means provides a linear restoring moment between the side frame and the bolster when the side frame is rotated about the end of the bolster.

17. The assembly of claim 16 wherein each pair of anchoring means includes an outside stub anchor having one end adapted to engage a link, the outside stub anchor being fixedly disposed to the bolster on one side of the longitudinal axis of each side frame, and an inside stub anchor having one end adapted to engage a link, the inside stub anchor being fixedly disposed to the bolster on the other side of the longitudinal axis of each side frame.

18. The assembly of claim 16 wherein each pair of anchoring means includes a rocker arm pivotably mounted in a pivot block on one end of the bolster, the rocker arm having one end adapted to engage a link, and an inside stub anchor having one end adapted to engage a link, the inside stub anchor being fixedly disposed to the bolster inside the longitudinal axis of each side frame.

19. The assembly of claim 16 wherein the first pivot means is a spherical ball-pivot and is mounted in a side frame opening defined by elongated substantially longitudinal, vertical and angulated members of the side frame.

20. The assembly of claim 16 wherein each spring arm, near each end, is provided with a hook, and each anchoring means is provided with a hook, each hook of a spring arm being adapted to be coupled to an adjacent hook of an anchoring means; and, the linking means is a continuous link.

21. The assembly of claim 16 wherein each spring arm, near each end, is provided with a ring, and each anchoring means is provided with a ring, each ring of a spring arm being adapted to be coupled to an adjacent ring of an anchoring means; and the linking means is an assembly of split links.

22. In a railroad car truck assembly having longitudinally spaced apart wheel sets, transversely extending axles, and wheels mounted to the axles, transversely spaced apart longitudinally extending side frames mounted to the axles, and a transversely extending bolster mounted to the side frames, the improvement comprising, a pair of first and second yaw stabilizing means oppositely mounted in substantially mirror-image relationship with each other, on each side frame, each yaw stabilizing means comprising, a side frame pivot means mounted on each side frame at equidistant locations relative to the lateral centerline through the bolster, and a pivot bar having angularly diverging spring arms pivotably disposed on the pivot means for reciprocal motion in a lateral plane, one spring arm being inside, relative to the longitudinal axis of the side frame, and the other being outside;

oppositely disposed bolster pivot means mounted on each side of the lateral axis of each bolster and near the end of the bolster, at equidistant locations relative to the longitudinal axis of the side frame;

a rocker arm pivotably disposed on each bolster pivot means, to allow a rocking motion of the rocker arm in a lateral plane;

an inside anchoring means oppositely mounted from each bolster pivot means and within substantially the same lateral plane, the inside anchoring means being adapted to engage the second linking means at a predetermined location laterally spaced apart from the longitudinal centerline of the side frame;

oppositely disposed linking means, one adapted to engage one end of each rocker arm and one end of each outside spring arm, the other linking means being adapted to engage the anchoring means and each inside spring arm, each linking means adapted to provide limited movement of each spring arm in a lateral direction, each linking means having a minimum length ineffective to substantially bend a spring arm for a predetermined suspension spring deflection; and, locking means to lock one end of each rocker arm in a position away from the bolster's surface to pre-load each spring arm in opposed bending to each other;

whereby both, limited lateral movement of the bolster and such vertical movement as is provided by suspension springs in the side frames, is provided for; and each yaw stabilizing means provides a linear restoring moment between the side frame and the bolster when the side frame is rotated about the end of the bolster.

23. The assembly of claim 22 wherein the yaw stabilizing means fails to noticeably increase the unsprung weight of the railroad car.

24. The assembly of claim 23 wherein each spring arm, near each end, is provided with a hook, each rocker arm near its one end is provided with a hook, and each anchoring means is provided with a hook, each hook of a spring arm being adapted to be coupled to a hook selected from an adjacent hook of an anchor block spring arm and an adjacent hook on a rocker arm, and the linking means is a continuous link.

25. The assembly of claim 23 wherein each spring arm, near each end, is provided with a ring, and each rocker arm near its one end is provided with a ring, and each anchoring means is provided with a ring, each ring of a spring arm being adapted to be coupled to a ring selected from an adjacent ring of an anchor block and an adjacent ring on a rocker arm; and the linking means is an assembly of split links.

26. A method of stabilizing a railroad car truck assembly against deleterious yawing at any speed up to 240 km/hr (150 mph) without adding stiffness to the truck except for stabilization forces when the truck's components are warped, and without locking the bolster in position relative to the side frames so as to allow lateral and vertical movement of the bolster, the method comprising, mounting a pair of first and second yaw stabilizing means in substantially mirror-image relationship with each other relative to the lateral centerline of the bolster, on each side frame, each yaw stabilizing means comprising a side frame pivot means mounted on each side frame at equidistant locations relative to the lateral centerline through the bolster, and a pivot bar having angularly diverging spring arms pivotably disposed on the pivot means for reciprocal motion in a lateral plane;

preloading the spring arms to a predetermined extent by drawing them towards each other;

fixing a pair of first and second anchoring means oppositely disposed relative to each other and fixed to the bolster on either side of the longitudinal axis of each side frame, the anchoring means being adapted for engagement with first and second linking means, respectively, on opposite sides of the longitudinal axis of the side frame, the first linking means adapted to engage one end of a first anchoring means to one end of a first spring arm; the second linking means adapted to engage one end of a second anchoring means to one end of the second spring arm; each linking means adapted to provide limited movement of each spring arm in a lateral plane, each linking means having a minimum length ineffective to substantially bend a spring arm for a predetermined suspension spring deflection;

whereby warping of the truck when negotiating a curve is minimized.

27. The method of claim 26, including, mounting a pair of oppositely disposed bolster pivot means on each side of the lateral axis through the bolster and near the end thereof, at equidistant locations relative to the longitudinal centerline through the side frame;

pivotably disposing a rocker arm on each bolster pivot means, to allow a rocking motion of the rocker arm in a lateral plane;

connecting one end of each rocker arm and one end of each spring arm with a linking means adapted to provide limited movement of each spring arm in a lateral plane, each linking means having a minimum length ineffective to substantially bend a spring arm for a predetermined suspension spring deflection; and, biasing the other end of each rocker arm away from the bolster's surface to pre-load each spring arm in opposed bending to each other and locking the end of each rocker arm in a predetermined position.

* * * * *